US011248765B2

(12) United States Patent
Taudt et al.

(10) Patent No.: US 11,248,765 B2
(45) Date of Patent: Feb. 15, 2022

(54) OPTICAL DEVICE FOR A MOTOR VEHICLE HEADLIGHT COMPRISING OPTICAL WAVEGUIDES

(71) Applicant: ZKW Group GmbH, Wieselburg (AT)

(72) Inventors: Lukas Taudt, Wieselburg (AT); Rene Kamleithner, Hofamt Priel (AT); Dominik Wanitschek, Schönbühel-Aggsbach (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 17/264,425

(22) PCT Filed: Jul. 12, 2019

(86) PCT No.: PCT/EP2019/068786
§ 371 (c)(1),
(2) Date: Jan. 29, 2021

(87) PCT Pub. No.: WO2020/025291
PCT Pub. Date: Feb. 6, 2020

(65) Prior Publication Data

US 2021/0310627 A1 Oct. 7, 2021

(30) Foreign Application Priority Data

Aug. 3, 2018 (EP) ..... 18187242

(51) Int. Cl.
*F21V 9/00* (2018.01)
*F21S 41/24* (2018.01)
(Continued)

(52) U.S. Cl.
CPC ..... *F21S 41/24* (2018.01); *F21S 41/143* (2018.01); *F21S 41/153* (2018.01); *F21S 41/29* (2018.01);
(Continued)

(58) Field of Classification Search
CPC ..... F21S 41/192; F21S 45/48; F21S 45/49; F21S 41/24; F21S 41/29
See application file for complete search history.

(56) References Cited

U.S. PATENT DOCUMENTS 9,664,847 B2 * 5/2017 Krenn ..... F21S 41/663
2005/0140270 A1 6/2005 Henson et al.
(Continued)

FOREIGN PATENT DOCUMENTS

DE 102012213843 B3 9/2013
DE 102017209815 A1 * 12/2018 ..... F21S 41/19
EP 3339720 A1 12/2020

OTHER PUBLICATIONS

International Search Report for PCT/EP2019/068786, dated Oct. 18, 2019. (2 pages).
(Continued)

*Primary Examiner* — Omar Rojas Cadima
(74) *Attorney, Agent, or Firm* — Eversheds Sutherland (US) LLP

(57) ABSTRACT

The invention relates to an optical device (1) for a motor vehicle headlight, said device comprising the following: a primary optical element (100) having a main body (101) and a plurality of optical waveguide bodies (110) having a light-receiving surface (120) and a light-emitting surface (130); a holder (200) on which the primary optical element (100) is arranged, wherein the optical waveguide bodies (110) penetrate the holder (200) via an opening region (201) of the holder; and a covering element (300) which is arranged on the holder (200) and comprises openings (310) which receive the optical waveguide bodies (110), wherein the covering element (300) can be connected to the holder by means of a projection (420) comprising an engaging section (421) and an end section (422) and a guide recess (410) having a first region (411) and a second region (412), said
(Continued)

Figure 1:
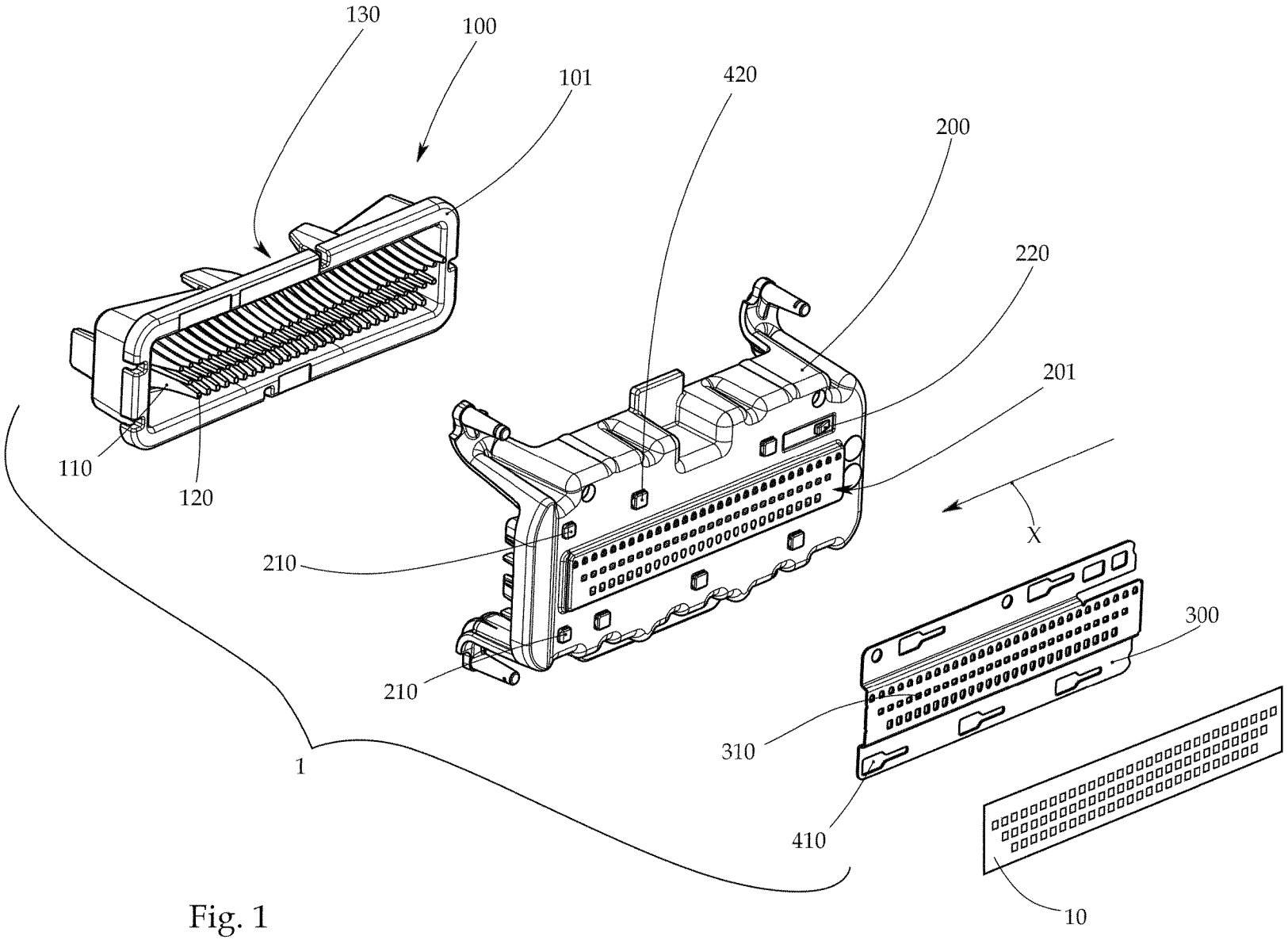

second region extending in a slip-on direction (X), wherein the projection (420) can be inserted in the first region (411) such that the second region (412) can be slipped onto the engaging section (421) by means of the movement of the covering element (300) in the slip-on direction (X).

16 Claims, 3 Drawing Sheets

(51) Int. Cl.

| | |
|---|---|
| ***F21S 41/29*** | (2018.01) |
| ***F21S 41/153*** | (2018.01) |
| ***F21S 41/663*** | (2018.01) |
| ***F21S 45/49*** | (2018.01) |
| ***F21S 41/143*** | (2018.01) |
| *F21Y 115/10* | (2016.01) |
| *F21Y 105/10* | (2016.01) |

(52) U.S. Cl.
CPC ..... *F21S 41/663* (2018.01); *F21S 45/49* (2018.01); *F21Y 2105/10* (2016.08); *F21Y 2115/10* (2016.08)

(56) References Cited

U.S. PATENT DOCUMENTS

| | | | | |
|---|---|---|---|---|
| 2014/0226355 | A1 | 8/2014 | Blandin et al. | |
| 2015/0204499 | A1 | 7/2015 | Pawliczek et al. | |
| 2017/0151901 | A1 | 6/2017 | Sazuka | |
| 2017/0370550 | A1 | 12/2017 | Japs et al. | |
| 2018/0264994 | A1* | 9/2018 | Stoehr ..... | F21S 41/265 |

OTHER PUBLICATIONS

European Search Report for EP Application No. 18187242, dated Jan. 16, 2019. (1 page).

* cited by examiner

OPTICAL DEVICE FOR A MOTOR VEHICLE HEADLIGHT COMPRISING OPTICAL WAVEGUIDES

The invention relates to an optical device for a motor vehicle headlight, wherein the device comprises:

- a primary optical element with a main body, and with a plurality of optical waveguide bodies projecting from the main body so as to form a desired light distribution from the light of light sources, which optical waveguide bodies in each case have a light-receiving surface, into which light from light sources can be fed, and a light-emitting surface,
- a holder, on which the main body of the primary optical element is arranged on a front face of the holder, wherein the optical waveguide bodies of the primary optical element penetrate the holder through an opening region of the holder, and
- a covering element, which is arranged on a rear face of the holder, facing away from the main body of the primary optical element, wherein the covering element has a number of openings corresponding to the number of optical waveguide bodies, and openings corresponding to the optical waveguide bodies, which openings are set up so as to receive the optical waveguide bodies of the primary optical element and to hold them in position, wherein the covering element can be connected to the holder by means of at least one first engaging element arranged on the covering element, which first engaging element engages with at least one second engaging element arranged on the holder.

The invention further relates to a motor vehicle headlight with at least one lighting device in accordance with the invention, or with at least one light module with at least one lighting device in accordance with the invention.

The above-cited lighting devices are usually used in connection with light modules or motor vehicle headlights so as to generate light distributions, preferably a dipped beam and/or a full beam distribution. For this purpose, light from light sources is fed into the respective light-receiving surfaces of the optical waveguide bodies, which light is propagated in the optical waveguide bodies by means of reflection and/or total reflection on the side walls of the optical waveguide bodies, wherein the light exits again via the light-emitting surfaces of the respective optical waveguides.

For this purpose it is necessary that the primary optical element, that is to say, the optical waveguide bodies of the primary optical element, are precisely positioned with reference to the corresponding light sources.

For this purpose, for example, a holder can be provided, which holds the optical waveguide bodies in position with reference to the light sources, wherein such a holder can be made of a plastic. During operation of the lighting device, that is to say, the light sources, high temperatures can occur as a result of the heat radiation from the light sources. Since the optical waveguide bodies, and thus also the holder, are positioned relatively close to, and at a small distance from, the light sources, undesired thermal damage or deformation of the holder can occur, and thus also an alteration in the position of the optical waveguide bodies, or thermal damage can also occur as a result of the exposure to heat of the light sources in operation, by virtue of heat conduction.

In turn, damage to, or misalignment of, the optical waveguide bodies can result in the light image as depicted not meeting the desired requirements.

For this reason, a covering element is arranged between the holder and the light sources, which serves as a kind of heat shield. At the same time, however, it is important to ensure that the distance between the optical waveguide bodies and the light sources is unaltered, and that a suitable mounting is found for fixing on the holder, since there is little installation space between the holder and the light sources.

It is an object of the invention to provide an improved optical device for a motor vehicle headlight.

This object is achieved in that the at least one second engaging element is designed as a projection projecting from the holder, with an engaging section, which has a height and a width extending away from the holder, and an end section, which has a height and a width, and wherein the at least one first engaging element is designed as a guide recess in the covering element, wherein the guide recess has a first region and a second region, which in comparison to the first region is tapered, which second region extends along a slip-on direction and has a width extending transversely to the slip-on direction, wherein the projection can be inserted into the first region of the guide recess and can be moved within the guide recess in such a manner that the second region of the guide recess can be slid onto the engaging section of the projection by means of a movement of the covering element in the slip-on direction.

The primary optical element can advantageously be made in one piece from a transparent, light-conducting, and mouldable, plastic.

"In one piece" is understood to mean that the primary optical element is manufactured in one piece, preferably by means of an injection moulding process.

In an appropriate form of embodiment, the primary optical element can be made of a silicone material.

By virtue of the elastomeric properties of a silicone material, removal from the mould during the production of the primary optical element is possible without an additional slider, as the primary optical element is preferably produced by means of an injection moulding process.

Likewise, it can be advantageous for the primary optic to be made of a poly(organo)siloxane.

Provision can advantageously be made for the holder to have an opening region with at least one opening, in which the optical waveguide bodies can be received and positioned.

The individual optical waveguide bodies can be held in their position with reference to the light sources particularly well, if the holder and/or the covering element has an opening for each optical waveguide body in which the associated optical waveguide body is received and positioned with a precise fit.

The openings take the form of holes or receptacles in the holder or the covering element, with a precisely matched cross-section for the respective optical waveguide body; these are inserted into the associated openings, and held in the desired position by the holder.

Provision can be made for the holder and/or the covering element to have openings corresponding to the number of optical waveguide bodies, each of which is assigned to one optical waveguide body.

It can be beneficial if the holder and/or the covering element receive the optical waveguide bodies in their end regions facing towards the light-receiving surfaces.

Here the optical waveguide bodies can protrude slightly rearwards from the receptacles, that is to say, the openings of the covering element, or can finish flush with the latter.

Provision can, for example, be made for the optical waveguide bodies to be designed in the shape of a truncated cone or a trapezoid.

In principle, all multi-sided pyramid bases come into consideration, e.g. hexagonal bases, for instance in the form of wedge-shaped honeycombs. The base surface shape is closely related to the LED chip arrangements and the desired light shaping, wherein the light entrance and exit can be significant.

Furthermore, if the covering element is designed as a plate, or from sheet metal, provision can be made for this plate to rest on the holder in a slipped-on state. Here provision can be made for the plate or sheet to have deformations corresponding to the shape of the holder.

Advantageously, the width of the engaging section can be less than the width of the end section.

This ensures that the covering element is held positively in a form fit on the holder in a slipped-on state.

Provision can furthermore be made for the width of the second region of the guide recess to be at least equal to the width of the engaging section of the projection.

The width of the engaging section should preferably be only slightly less than the width of the second region of the guide recess, so as to prevent the covering element from moving transversely to the slip-on direction.

Likewise, it can be beneficial if the end section of the projection has a taper with respect to its height in the opposite direction to the slip-on direction.

This makes it easier to put on, and then slip on, the covering element, that is to say, the individual engaging sections of the projections.

Provision can advantageously be made for the covering element to have a thickness, wherein the height of the engaging section of the projection corresponds at least to the thickness of the covering element, preferably to the thickness in the region of the guide recess of the covering element.

The covering element can advantageously have a constant thickness.

In an appropriate form of embodiment, the holder can have at least one stop element, which stop element is set up so as to limit the movement of the covering element in the direction of the slip-on direction, wherein at least two stop elements are preferably provided.

Provision can furthermore be made for at least two first engaging elements, and at least two second engaging elements corresponding to the first engaging elements, to be provided.

At least one first engaging element and a corresponding second engaging element are preferably arranged above and below the openings of the covering element, that is to say, above and below the opening region of the holder.

The terms "above" and "below" refer to the longitudinal axis of the primary optical element, that is to say, of the main body of the primary optical element, preferably transverse to the main direction of radiation of the light sources, in the assembled state of the optical device.

"Main direction of radiation" is understood to mean the direction in which the light sources emit the most, that is to say, the strongest light, as a result of their directionality.

It can be beneficial if at least one thickening element is arranged on a side of the end section of the projection opposite the covering element in the slipped-on state of the covering element, that is to say, on a side of the end section of the projection facing towards the holder, wherein the distance between the holder and the at least one thickening element is less than the height of the engaging section of the projection, wherein at least two thickening elements are preferably arranged on the end section.

By this means the covering element, when it is slipped onto the holder, is additionally pressed onto the holder, so that the covering element is fixed as firmly as possible onto the holder.

The thickening elements can preferably be rounded, that is to say, form part of a spherical body. By this means it is even easier to slip on the covering element.

Provision can be made for at least one latching lug to be arranged on the holder, which is set up so as to latch in a fixing recess corresponding to the latching lug, which recess is provided on the covering element.

The latching lug and the fixing recess are preferably arranged in such a way that the latching lug only fully engages in the fixing recess when the covering element rests against, or abuts against, the stop elements.

This ensures that the covering element is also fixed in the opposite direction to the slip-on direction.

The object is also achieved with an illumination device with at least one optical device and a number of light-emitting light sources corresponding to the number of optical waveguide bodies, which light is provided for feeding into the at least one optical device.

The illumination device preferably takes the form of a "pixel light device", wherein the light sources are arranged in rows and columns.

In such a "pixel light device", the light sources can be controlled independently of each other, as a result of which different light distributions can be generated, in particular an adaptive full beam light distribution.

It can be beneficial if the light sources in each case comprise one or more light-emitting diodes.

Preferably, provision can be made for each light source to comprise in each case one or a plurality of light-emitting diodes. Each light source can preferably be controlled separately, and can be switched on and off accordingly, and can preferably also be dimmed. If a light source consists of a plurality of light-emitting diodes, it can also be advantageous if each of the light-emitting diodes can be controlled separately.

Here provision can be made for exactly one, or at least one, light source to be assigned to each optical waveguide body.

The object is also achieved by a light module with at least one lighting device in accordance with the invention.

Furthermore, the object is achieved with a motor vehicle headlight with at least one lighting device in accordance with the invention, or a light module with at least one lighting device in accordance with the invention.

With a lighting device and/or light module in accordance with the invention, for example, a dipped beam and/or a full beam can be generated, for which purpose, for example, the left headlight and the right headlight each comprise a lighting device and/or light module in accordance with the invention, with which the left-hand and the right-hand parts of the light distribution are generated respectively. In the direction of light emission in front of the holder, a secondary optical element, usually a lens, is provided, by means of which the respective light distribution can be generated.

However, the lighting device and/or light module in accordance with the invention can also be used for a reversing light.

Figure 2A:
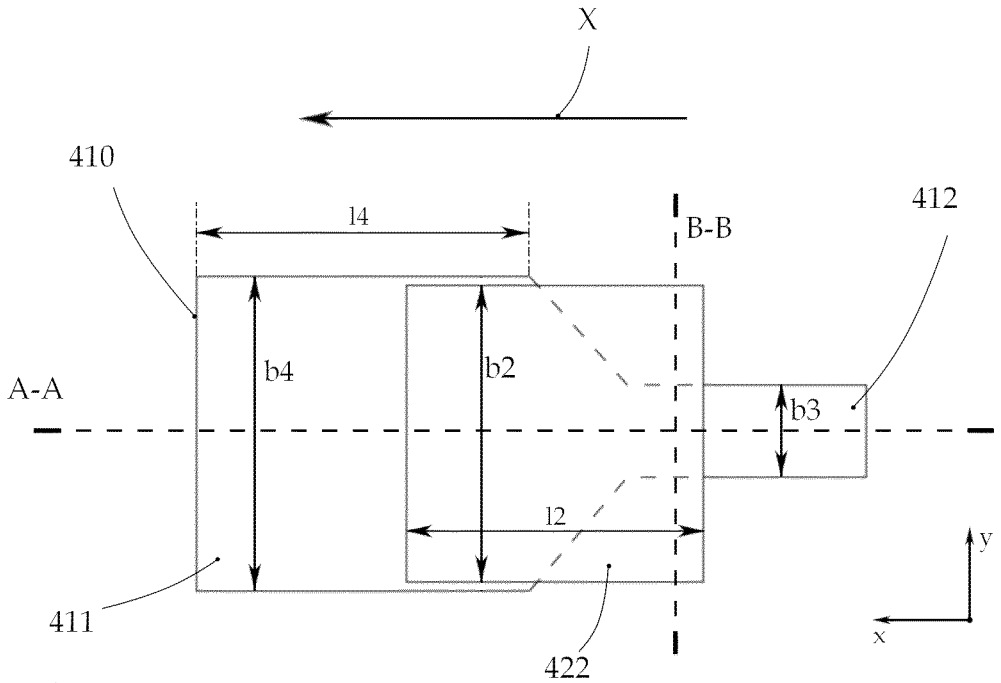
Figure 2B:
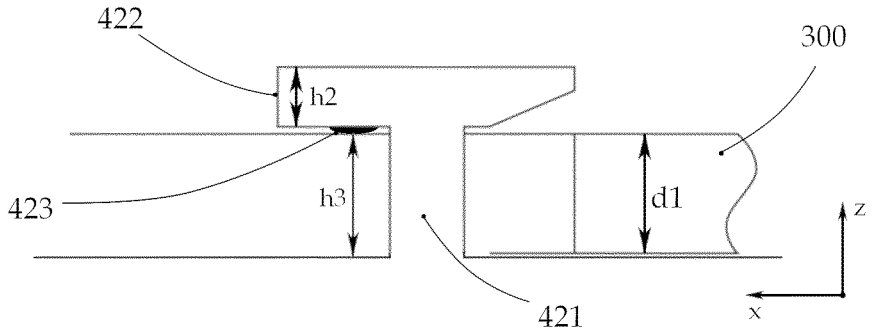
Figure 2C:
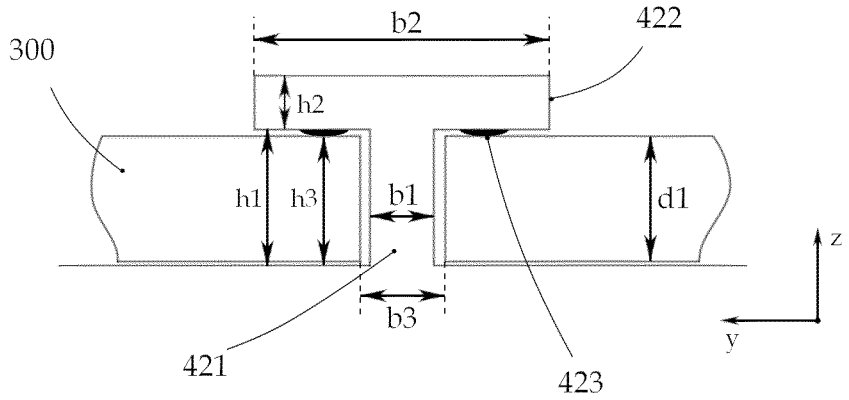
Figure 3:
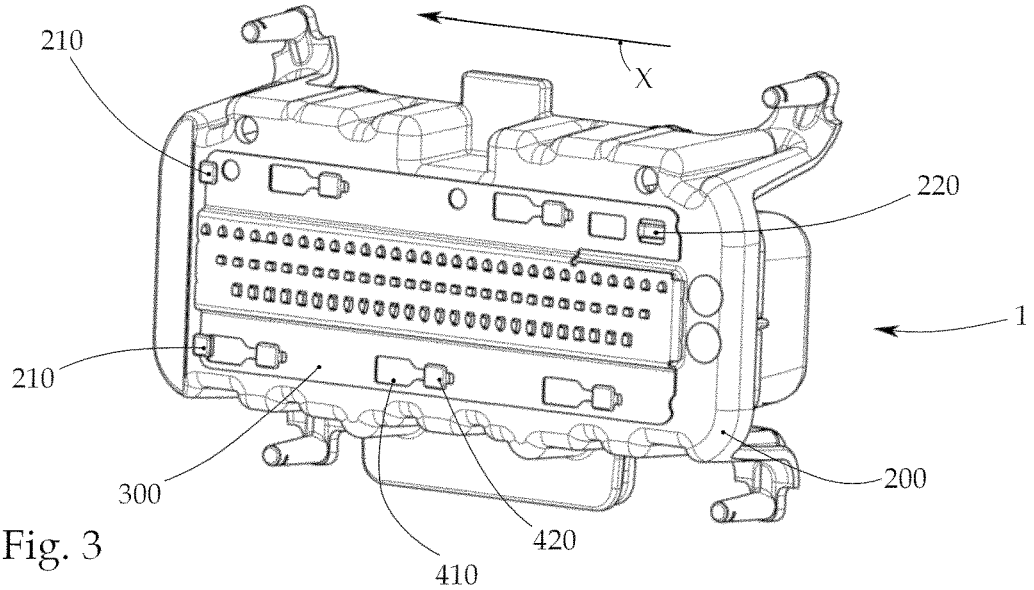
Figure 4:
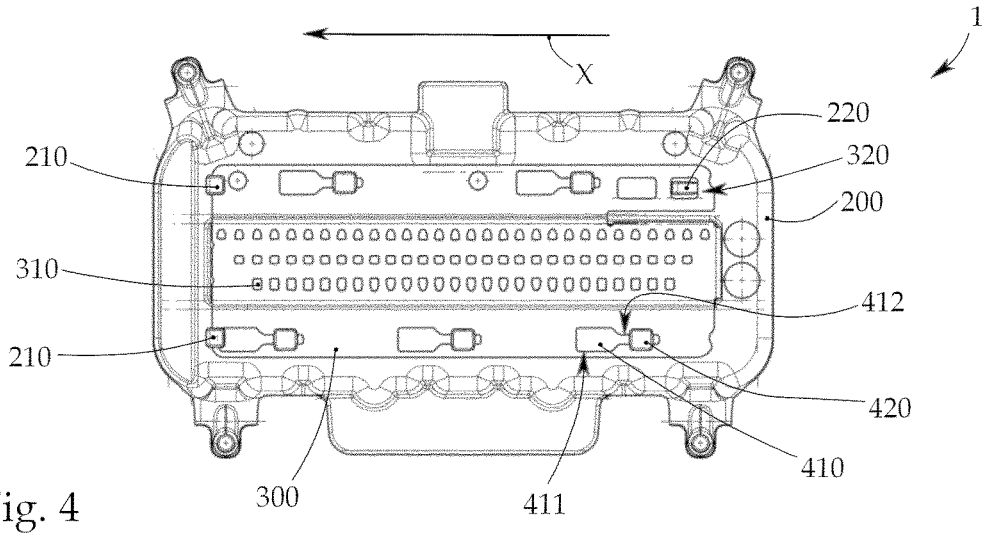
Figure 5:
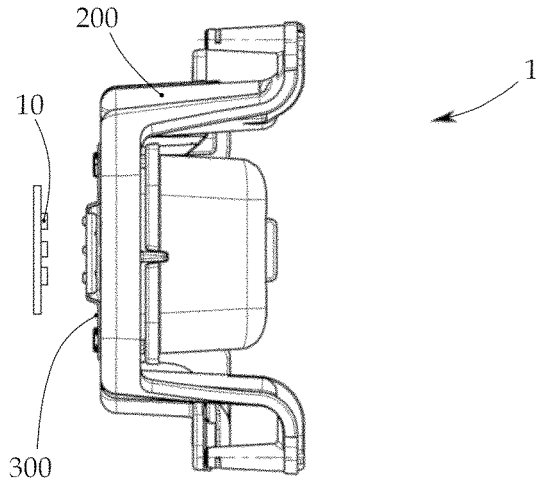

In what follows the invention is explained in more detail with the aid of exemplary drawings. Here:

FIG. 1 shows an exploded view of an exemplary optical device with a holder and a covering element, wherein a projection projecting from the holder is set up so as to engage with a guide receptacle of the covering element, in order to connect the holder to the covering element, FIG. 2A shows a schematic detail of the guide receptacle and the projection in a plan view, FIG. 2B shows a cross-section of the illustration in FIG. 5A along the line of cut A-A, FIG. 2C shows a cross-section of the illustration in FIG. 5B along the line of cut B-B, FIG. 3 shows a perspective view of the optical device in FIG. 1 in an assembled state, FIG. 4 shows a rear view of the optical device in FIG. 3, and FIG. 5 shows a side view of the optical device in FIG. 4 with arranged light sources.

FIG. 1 shows an exemplary optical device 1 in an exploded view, wherein a plurality of light sources 10 are arranged on a rear face of the device 1; these are set up so as to emit light beams in a main direction of radiation.

The optical device 1 comprises a primary optical element 100 with a main body 101 and with a plurality of optical waveguide bodies 110 projecting from the main body 101, which optical waveguide bodies in FIG. 1 are arranged in the main direction of radiation of the light sources, and in each case have a light-receiving surface 120, into which the light beams of the light sources can be fed, together with a light-emitting surface 130.

The device 1 furthermore comprises a holder 200, on which the main body 101 of the primary optical element 100 is arranged, that is to say, can be attached, on a front side of the holder 200, wherein the optical waveguide bodies 110 of the primary optical element penetrate the holder 200 through an opening region 210 of the holder 200.

The device 1 furthermore comprises a covering element 300, which is arranged on a rear face of the holder 200, facing away from the main body 101 of the primary optical element 100, and has a thickness d1, preferably a constant thickness, wherein the covering element 300 has a number of openings 310 corresponding to the number of optical waveguide bodies 110, and openings 310 corresponding to the optical waveguide bodies 110, which openings 310 are set up so as to receive the optical waveguide bodies 110 of the primary optical element 100, and to hold them in position.

In the example shown, the covering element 300 can be connected to the holder 200 by means of five first engaging elements 410 arranged on the covering element 300, which in each case are provided so as to engage with second engaging elements 420 arranged on the holder 200.

In the example of embodiment shown in the figures, the second engaging elements 420 are in each case designed as a projection 420 projecting from the holder 200, and the first engaging elements 410 are in each case designed as a guide recess 410 in the covering element 300. FIGS. 2A, 2B and 2C in each case show details of the connectable engaging elements.

The projections 420 also have, as can be seen more clearly in FIG. 2A for example, an engaging section 421 which has a height h1 extending from the holder 200, and a width b1, and an end section 422, which has a height h2, and a width b2, and a length 12. In the example of embodiment shown, the width b1 of the engaging section 421 is less than the width b2 of the end section 422.

Each guide recess 410 has a first region 411 with a width b4 and a length 14, and a second region 412 that is tapered in comparison to the first region 411, which second region 412 extends along a slip-on direction X, and has a width b3 extending transversely to the slip-on direction X, as can be seen in FIG. 2A.

A projection 420, that is to say, its end section 422 can in each case be passed through the first region 411 of a guide recess 410, so that the second region 412 of the guide recess 410 can be pushed onto the engaging section 421 of the projection 420 by means of a movement of the covering element 300 in the slip-on direction X, wherein the width b3 of the second region 412 of the guide recess 410 corresponds at least to the width b1 of the engaging section 421 of the projection 420, and wherein the height h1 of the engaging section 421 of the projection 420 corresponds at least to the thickness d1 of the covering element 300, preferably to the thickness in the region of the guide recess 410 of the covering element 300.

Furthermore, the width b2 and the length 12 of the end section 422 of the projection 420 are respectively at least slightly less than the width b4 and the length 14 of the first region 411 of the guide recess 410.

To this end FIG. 2A shows an engaging section 421 of a projection 420 partially slipped on into the second region 412 of the guide recess 410. FIG. 2B shows a cross-section from the illustration in FIG. 2A along the line of cut A-A, wherein it can be seen that the end section 422 of the projection 420 has a taper with respect to its height h2 in the opposite direction to the slip-on direction X.

Furthermore, it can be seen in FIG. 2B and in FIG. 2C, respectively, that two thickening elements 423 are arranged on a side of the end section 422 of the projection 420 opposite to the covering element 300 in the slipped-on state of the covering element 300, wherein a distance h3 between the holder 200 and the at least one thickening element 423 is less than the height h1 of the engaging section 421 of the projection 420, as shown for example in FIG. 2C, which shows a section from the illustration in FIG. 2A along the line of cut B-B.

FIG. 3 and FIG. 4 each show an assembled state of the optical device 1, in which the covering element 300 is connected to the holder 200, that is to say, is fully slipped onto the holder 200.

For this purpose, the holder 200 in the example shown has two stop elements 210, which stop elements 210 are set up so as to limit the movement of the covering element 300 in the direction of the slip-on direction X. The stop elements 210 are arranged on the holder 200, for example, in such a way that an outer edge region, that is to say, an end edge of the covering element 300, rests or abuts against the stop elements 210 in a fully slipped-on state of the covering element 300.

Furthermore, a latching lug 220 is arranged on the holder 200, which is set up so as to latch into a fixing recess 320 corresponding to the latching lug 220, which recess is provided on the covering element 300.

FIG. 5 shows a side view of the assembled optical device 1, wherein the light sources 10 are also shown, as already cited in the introduction.

LIST OF REFERENCE SYMBOLS

Optical device 1
Light sources 10
Primary optical element 100
Basic body 101
Optical waveguide body 110
Light-receiving surface 120
Light-emitting surface 130

Holder 200
Opening region 201
Stop element 210
Latching lug 220
Covering element 300
Opening 310
Fixing recess 320
Guide recess 410
First region 411
Second region 412
Projection 420
Engaging section 421
End section 422
Thickening element 423
Slip-on direction X

The invention claimed is:

1. An optical device (1) for a motor vehicle headlight, the optical device comprising:

a primary optical element (100) having a main body (101) and having a plurality of optical waveguide bodies (110) projecting from the main body so as to form a desired light distribution from the light of light sources, which optical waveguide bodies in each case have a light-receiving surface (120) into which light from light sources can be fed, and also a light-emitting surface (130);

a holder (200), on which the main body (101) of the primary optical element (100) is arranged on a front face of the holder (200), wherein the optical waveguide bodies (110) of the primary optical element penetrate the holder (200) through an opening region (201) of the holder; and a covering element (300) which is arranged on a rear face of the holder (200), facing away from the main body (101) of the primary optical element (100), wherein the covering element (300) has a number of openings (310) corresponding to the number of optical waveguides (10), and openings corresponding to the optical waveguides, which openings (310) are set up to receive the optical waveguide bodies (110) of the primary optical element (100) and to hold them in position, wherein the covering element (300) can be connected to the holder by means of at least one first engaging element arranged on the covering element (300), which first engaging element engages with at least one second engaging element arranged on the holder (200), wherein the at least one second engaging element is formed as a projection (420) projecting from the holder (200) with an engaging section (421), which has a height (h1) extending from the holder (200) and a width (b1), and an end section (422), which has a height (h2) and a width (b2), and wherein the at least one first engaging element is designed as a guide recess (410) in the covering element (300), wherein the guide recess (410) has a first region (411) and a second region (412) which is tapered in comparison to the first region, which second region (412) extends along a slip-on direction (X), and has a width (b3) extending transversely to the slip-on direction (X), wherein the projection (420) can be inserted into the first region (411) of the guide recess (410) and can be moved within the guide recess (410) in such a way that the second region (412) of the guide recess (410) can be slipped onto the engaging section (421) of the projection (420) by means of a movement of the covering element (300) in the slip-on direction (X).

2. The optical device according to claim 1, wherein the width (b1) of the engaging section (421) is less than the width (b2) of the end section (422).

3. The optical device according to claim 1, wherein the width (b3) of the second region (412) of the guide recess (410) corresponds at least to the width (b1) of the engaging section (421) of the projection (420).

4. The optical device according to claim 1, wherein the end section (422) of the projection (420) has a taper with respect to its height (h2) in the opposite direction to the slip-on direction (X).

5. The optical device according to claim 1, wherein the covering element (300) has a thickness (d1), wherein the height (h1) of the engaging section (421) of the projection (420) corresponds at least to the thickness (d1) of the covering element.

6. The optical device according to claim 1, wherein the holder (200) has at least one stop element (210), which stop element (210) is set up so as to limit the movement of the covering element (300) in the direction of the slip-on direction (X).

7. The optical device according to claim 1, wherein at least two first engaging elements (410) and at least two second engaging elements (420), corresponding to the first engaging elements (410), are provided.

8. The optical device according to claim 1, wherein at least one thickening element (423) is arranged on a face of the end section (422) of the projection (420) facing towards the holder (200), wherein the distance between the holder (200) and the at least one thickening element (423) is less than the height (h1) of the engaging section (421) of the projection (420).

9. The optical device according to claim 1, wherein at least one latching lug (220) is arranged on the holder (200), which latching lug is set up so as to latch in a fixing recess (320) corresponding to the latching lug (220), which fixing recess is provided on the covering element (300).

10. An illumination device comprising at least one optical device according to claim 1 with a number of light-emitting light sources (10) corresponding to the number of optical waveguide bodies (110), which light is configured to feed into the at least one optical device (1).

11. The illumination device according to claim 10, wherein exactly one, or at least one, light source is assigned to each optical waveguide body (110).

12. A light module comprising at least one illumination device according to claim 10.

13. A motor vehicle headlight comprising at least one light module according to claim 12.

14. The optical device according to claim 5, wherein the height (h1) of the engaging section (421) of the projection (420) corresponds at least to the thickness in the region of the guide recess (410) of the covering element (300).

15. The optical device according to claim 6, wherein the holder (200) comprises at least two stop elements (210).

16. The optical device according to claim 8, wherein at least two thickening elements (423) are arranged on the end section.

* * * * *